US007575472B1

(12) United States Patent
Wu

(10) Patent No.: US 7,575,472 B1
(45) Date of Patent: Aug. 18, 2009

(54) CONNECTOR ADAPTED FOR MOUNTING TO PANEL

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/231,632

(22) Filed: Sep. 3, 2008

(51) Int. Cl.
*H01R 13/73* (2006.01)

(52) U.S. Cl. ..... 439/545; 439/557

(58) Field of Classification Search ..... 439/545, 439/544, 553–559, 247
See application file for complete search history.

(56) References Cited

U.S. PATENT DOCUMENTS 5,199,900 A * 4/1993 Hayes, Sr. ..... 439/557
5,800,208 A * 9/1998 Ishizuka et al. ..... 439/557
6,579,111 B2 * 6/2003 Fukamachi ..... 439/247
6,945,816 B1 * 9/2005 Wu ..... 439/545
7,192,307 B1 * 3/2007 Tran et al. ..... 439/553

FOREIGN PATENT DOCUMENTS

CN 2762206 3/2006

* cited by examiner

*Primary Examiner*—Briggitte R Hammond
(74) *Attorney, Agent, or Firm*—Wei Te Chung

(57) ABSTRACT

A connector (101) adapted for mounting to a panel (200), includes an insulative housing (1) having a mating portion (12), a mounting portion (13) extending rearward from the mating portion, at least a lock tab (132) formed on a top or a bottom surface of the mating portion and disposed adjacent to the mounting portion; at least a retainer member (15) connected to a lateral side of the insulative housing, said retainer member having a passageway extending along a front-to-back direction, and an aperture (1521) defined in the retainer member (15) and communicating with the passageway; a slider member (5) including a main portion accommodated in the passageway of the retainer member, said main portion defining a cavity portion (542) with an inclined back side; a spring member (6) received in the passageway and capable of pushing the main portion sliding forwardly to reach a lateral side of the mounting portion; and a pusher member (7) having a finger portion extending into the cavity portion via the aperture of the retainer member and capable of pressing onto and sliding along the inclined back side to urge the slider member movement rearward.

20 Claims, 7 Drawing Sheets

CONNECTOR ADAPTED FOR MOUNTING TO PANEL

FIELD OF THE INVENTION

The present invention generally relates to a connector, and more particularly to a connector adapted to be mounted to a panel of an electronic device.

DESCRIPTION OF PRIOR ART

A connector is widely applied in an electronic devices, such a computer, sever, etc. One kind of connector is mounted to a panel (side portion) of the electrical device and connected to a cable which is further linked to other component inside of the electrical devices, serving as intermediate member and bridging the electronic device and other exterior electronic device.

For example, CN Pat. No. 2762206 discloses a kind of cable assembly attached to a panel of an electronic device, including a connector, a number of cables connected to the connector and further connected to other electronic components, and additional bolts and nuts applied to fasten the connector and the panel together. However, as the electronic device becomes lower profile, and any components thereof are also smaller, so do the bolts and nuts. Thus it is difficult for a user to manually operate the nuts and bolts to fasten the cable assembly to the panel, and tools, such as a screwdriver and a pincers are needed to turn the bolts and hold the nuts. Accordingly, the tools are required to operate the nuts and the bolts to demount the cable assembly from the panel.

Hence, an improved connector is required to overcome aforementioned problems.

SUMMARY OF THE INVENTION

Accordingly, an object of the present invention is to provide a connector which is easily mounted to or demounted from a panel.

In order to achieve the object set forth, a connector in accordance with the present invention comprises an insulative housing including a mating portion, a mounting portion extending rearward from the mating portion, at least a lock tab formed on a top or a bottom surface of the mating portion and disposed adjacent to the mounting portion; at least a retainer member connected to a lateral side of the insulative housing, said retainer member having a passageway extending along a front-to-back direction, and an aperture defined in the retainer member and communicating with the passageway; a slider member including a main portion accommodated in the passageway of the retainer member, said main portion defining a cavity portion with an inclined back side; a spring member received in the passageway and capable of pushing the main portion sliding forwardly to reach a lateral side of the mounting portion; and a pusher member having a finger portion extending into the cavity portion via the aperture of the retainer member and capable of pressing onto and sliding along the inclined back side to urge the slider member movement rearward.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
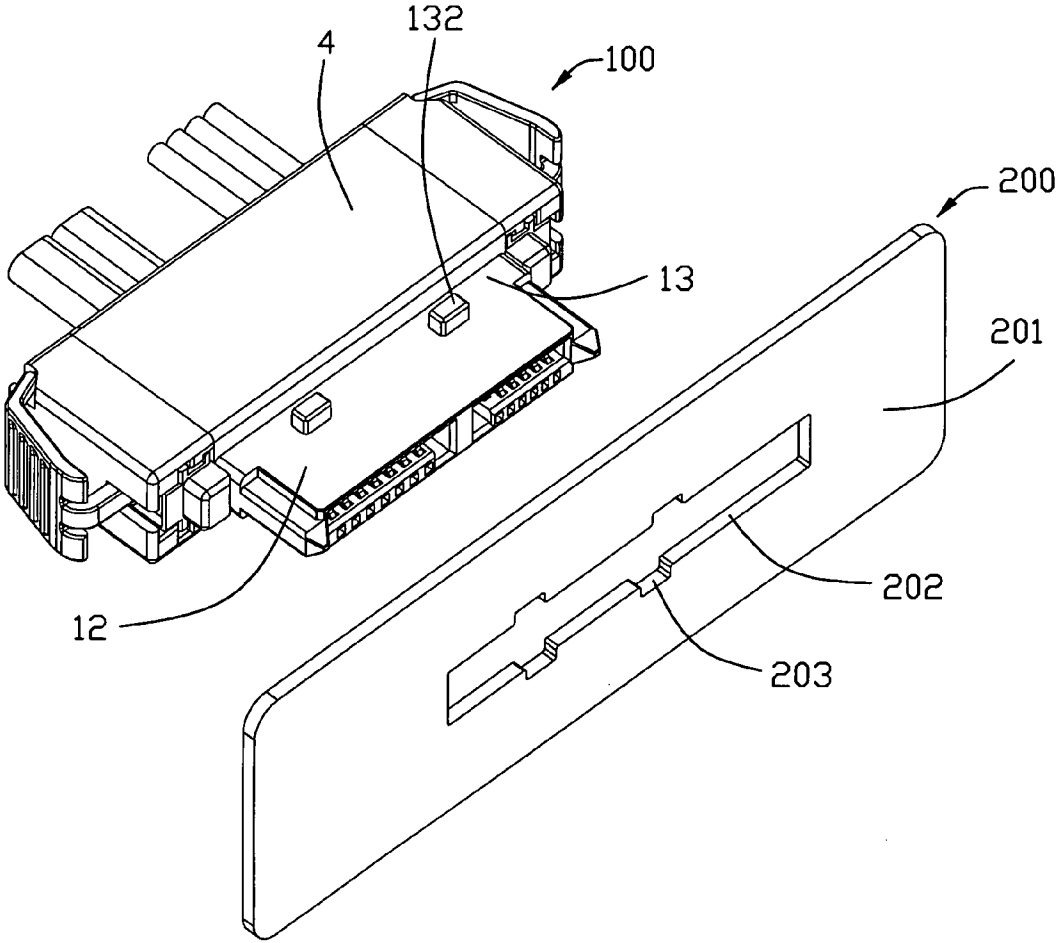
FIG. 1 shows a connector separated from a panel in accordance with the present invention.
Figure 2:
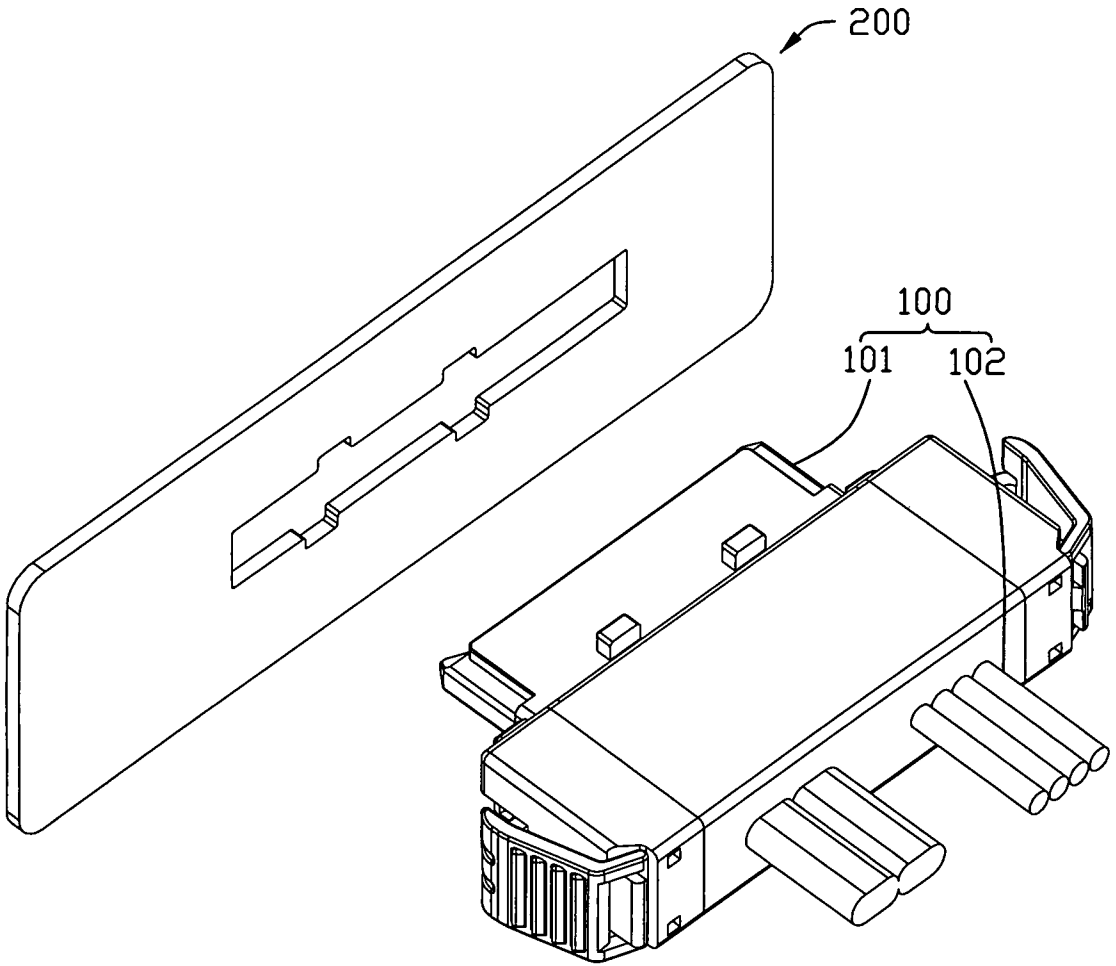
FIG. 2 is similar to FIG. 1, but viewed from other aspect.
Figure 3:
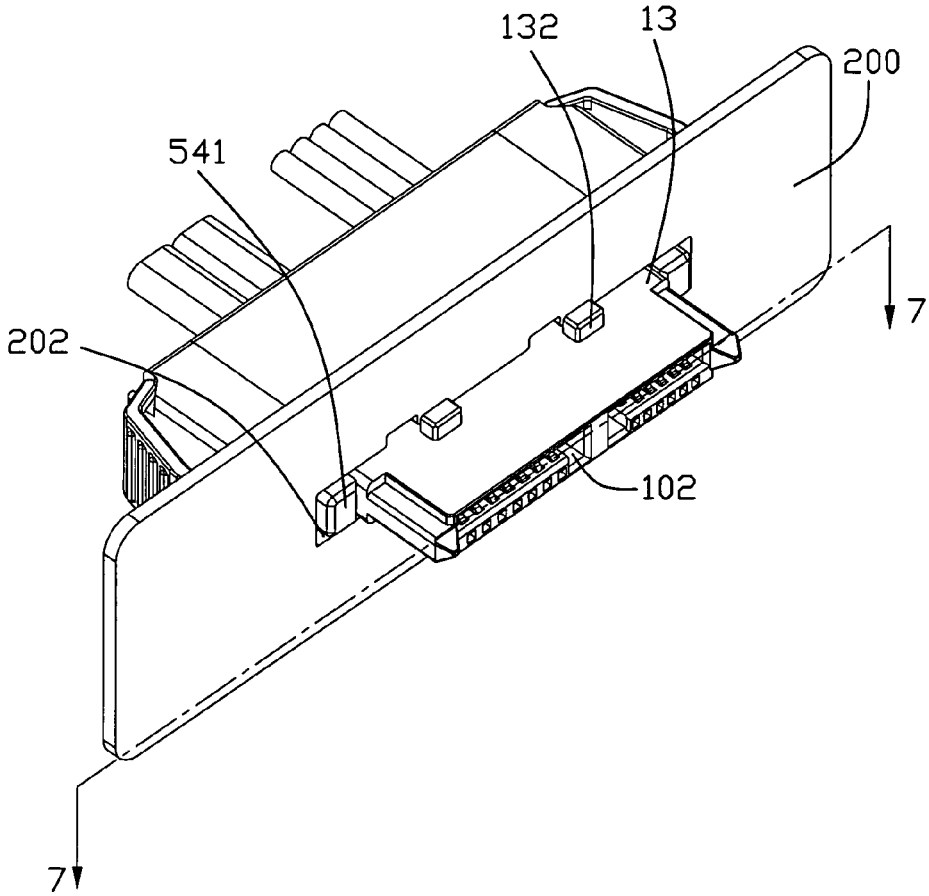
FIG. 3 shows the connector mounted to the panel.
Figure 4:
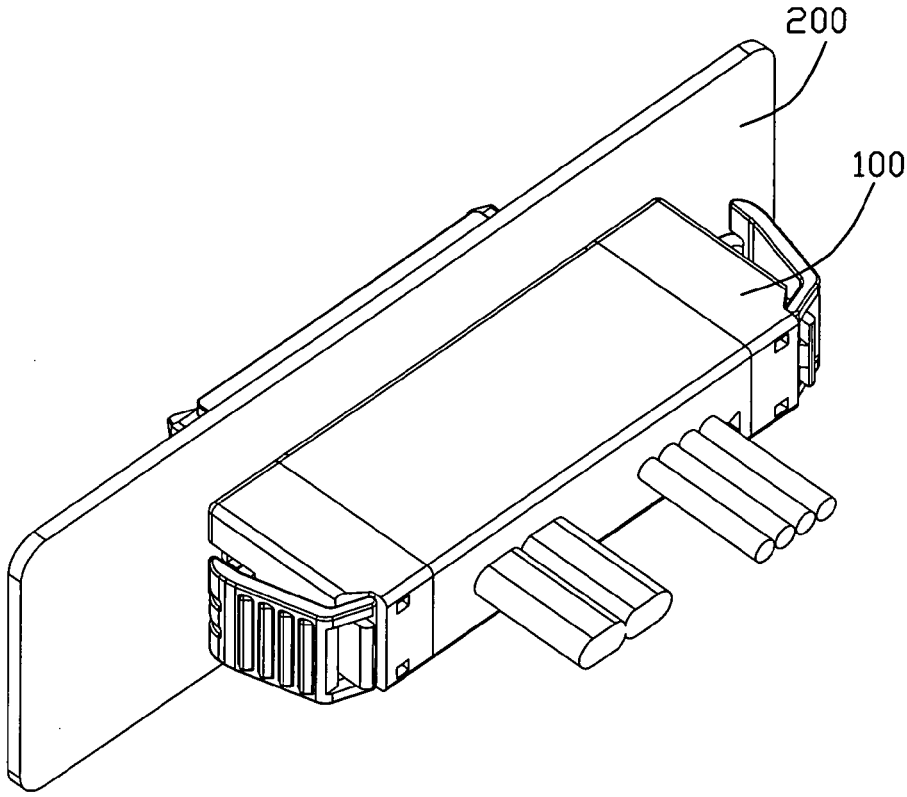
FIG. 4 is similar to FIG. 3, but viewed from other aspect.
Figure 5:
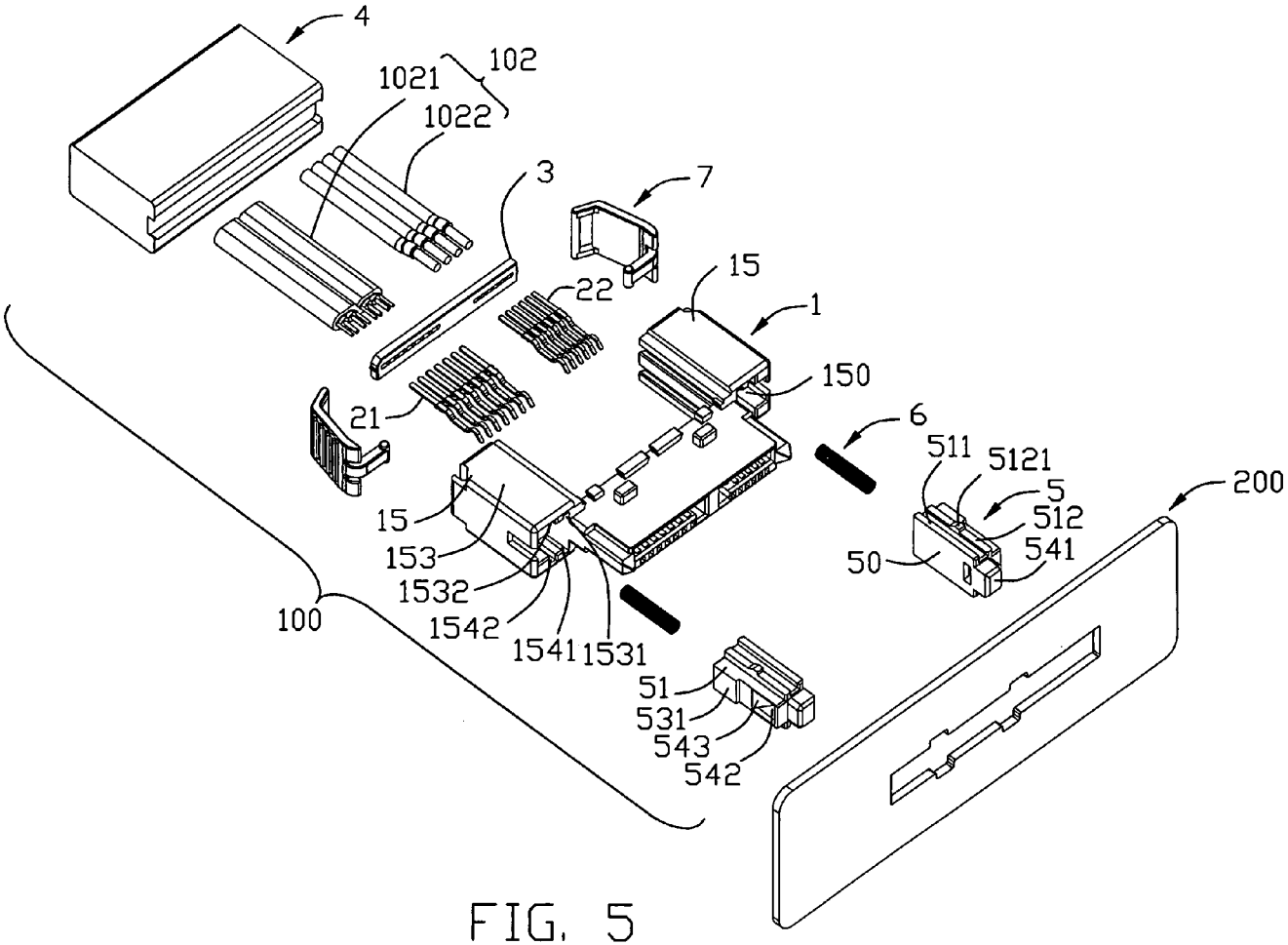
FIG. 5 is an exploded, perspective view of the connector and the panel.
Figure 6:
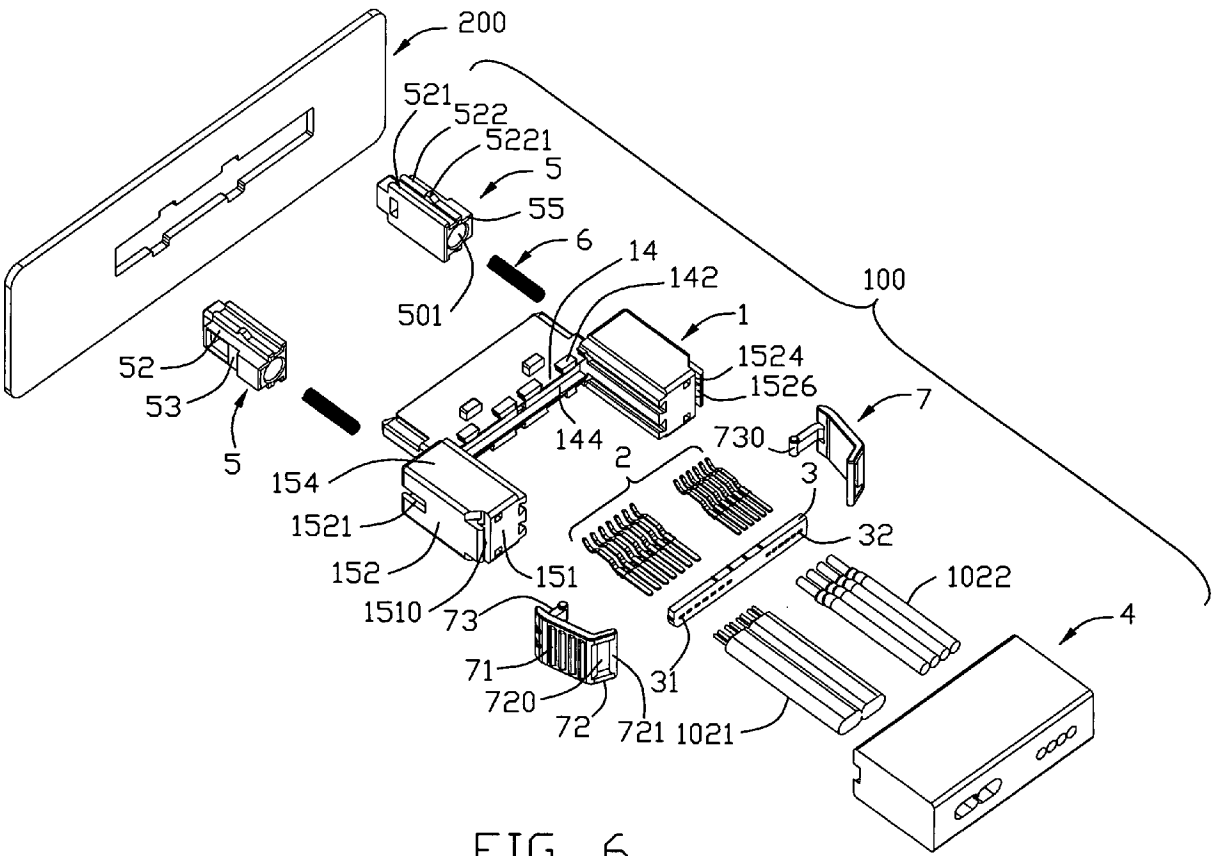
FIG. 6 is similar to FIG. 5, but viewed from other aspect.
Figure 7:
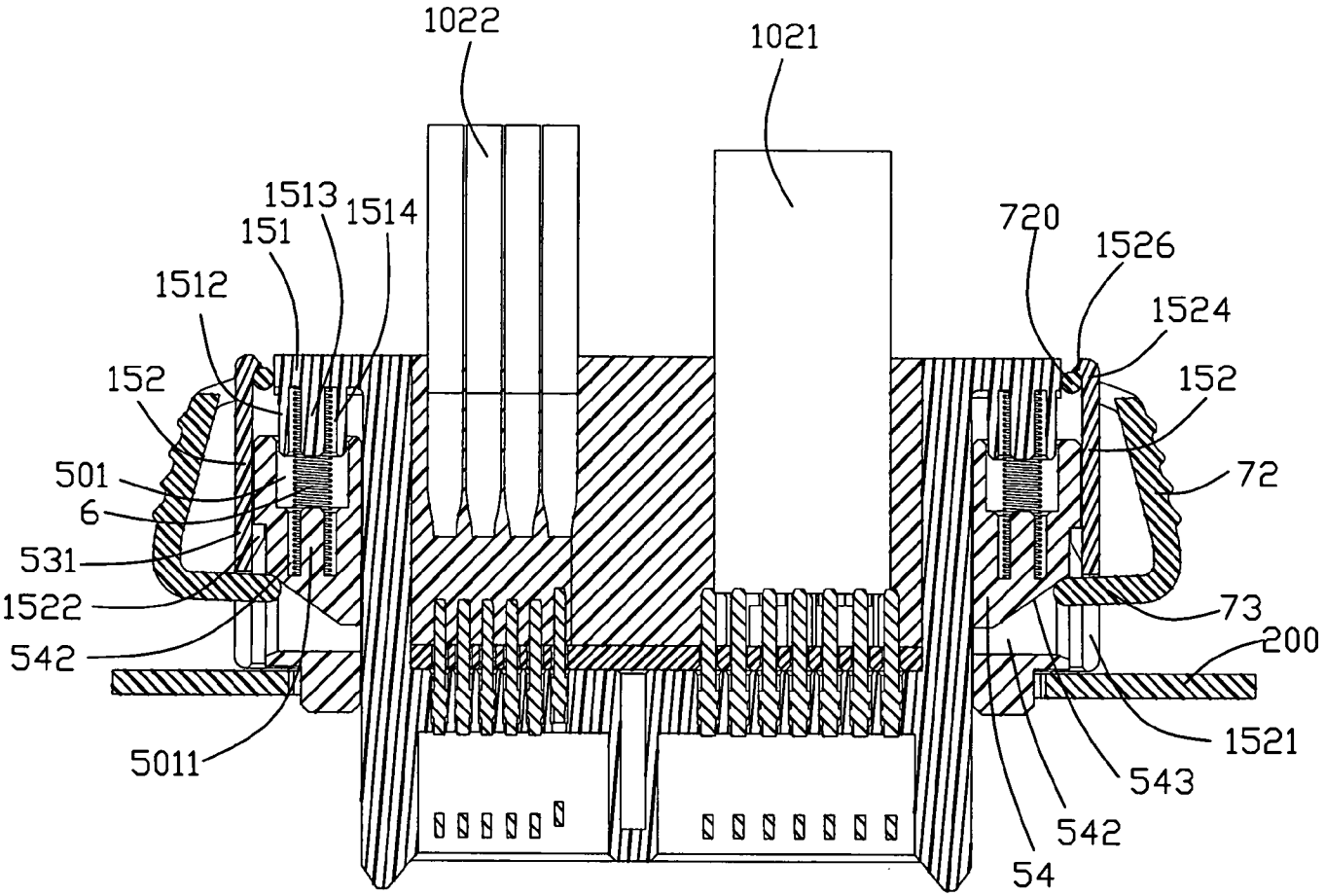
FIG. 7 is a cross-section view of FIG. 3 taken along line 7-7.

Referring to FIGS. 1-7, a cable assembly 100 is adapted to be mounted to a panel 200. The panel 200 may be a side of peripheral portion of a computer or other electronic device. The panel 200 includes a body portion 201, an elongated opening 202 through the body portion 201. A number of cutouts (or apertures) 203 disposed along and in communication to the elongated opening 202.

The cable assembly 100 comprises connector 101 and a plurality of wires 102 coupled thereto.

The connector 101 includes an insulative housing 1, a plurality of contacts 2, a spacer member 3, a cover 4, two slider members 5, and two spring members 6 and two pusher members 7. Detailed description of those element members and their relations are given below.

The insulative housing 1 has an elongated mating portion 12 which includes a number of walls (not numbered) interconnected together to form a mating port 120 thereamong, a mounting portion 13 connected to a rear face (not shown) of the mating portion 12 and adapted for being accommodated in the opening 202 of the panel 200 and having a dimension along a transversal direction being smaller than that of the opening 202, and a base portion 14 extending rearward from a back face of the mounting portion 13. Two pair of lock tabs 132 are formed on rear sections of a top and a bottom surfaces (not numbered) of the mating portion 12 and disposed adjacent the mounting portion 13. A number of protrusion members 142 are respectively located on a top and a bottom surfaces of the base portion 14. An elongated cavity 144 is recessed forwardly from a back surface of the base portion 14 for receiving the spacer member 3 therein.

Two retainer members 15 are connected to lateral sides of the base portion 14 and extend beyond the back surface of the base portion 14. Each of the retainer members 15 defines a passageway 150 extending along a longitudinal direction (or front-to-back direction) which is perpendicular to the transversal direction. The passageway 150 has a front outlet (not number). A slit or an aperture 1521 is defined in a front segment of a corresponding lateral wall 152 and in communication to the passageway 150. A lock member 1522 is formed on an inner surface of a front segment of the corresponding lateral wall 152. A first channel portion 1531 and a second channel portion 1532 are arranged in juxtaposed manner and defined in an inner portion of an up wall 153 and extend along the longitudinal direction, and a bottom wall 154 also has a first channel portion 1541 and a second channel portion 1542 similar to and aligning with the first and second channel portions 1531, 1532 in the up wall 153. A pair of first protruding members (not shown) are respectively formed in a front segments of the second channel portions 1532, 1542.

A cylindrical-shaped alignment member 1512 is formed on an inner surface of a rear wall 151 of the each retainer member 15 and extends forwardly therefrom. Furthermore, a circular shape positioning post 1513 disposed inside of the alignment member 1512 and projects forward from the inner surface of the rear wall 151. The positioning post 1513 and the alignment member 1512 are arranged in coaxial relationship and parallel to one another. A loop-shaped gap 1514 is formed between the positioning post 1513 and the alignment member 1512. However, it should be noted that the alignment member 1512 and the positioning post 1513 can be other shapes, such as rectangular, ellipse, and the like. A holder portion 1524 extends rearward from the lateral wall 152, and a cavity portion 1510 is formed between the holder portion 1524 and the corresponding lateral wall 152. A tab 1526 is formed on an inner surface of an end portion of the holder portion 1524.

The contacts 2 includes seven signal contacts 21 and six power contacts 22 which are arranged into two distinct rows along the transversal direction. The signal contacts 21 and the power contacts 22 are supported by the insulated housing 1, with mating segments (not numbered) thereof extending into the mating port 120, and tail portions (not numbered) extending rearward to surpass the back surface of the insulated housing 1 and further passing through holes 31, 32 of the spacer member 3. The signal wires 1021 and the power wires 1022 are respectively soldered to the tail portions of the signal contacts 21 and the power contacts 22.

Each of the slider members 5 has a lengthened main portion 50. Two first guide members 511, 521 and another two second guide members 512, 522 are respectively formed on a top surface 51 and a bottom surface 52 of the main portion 50. Both the first guide members 511, 521 and second guide members 512, 522 are capable of sliding/moving along the first channel portions 1531, 1541 and the second channel portions 1541, 1542. A pair of second protruding members 5121, 5221 are formed on the second guiding members 512, 522. The second protruding members 5121, 5221 can be blocked/stopped by the first protruding members (not shown) to prevent the slider member 5 sliding away the retainer member 15. A protrusion member 531 is formed on a back portion of the lateral side 53. The protrusion member 531 is capable of latching with the lock member 1522 to prevent the slider member 5 sliding away the retainer member 15 too.

A circular-shaped slot 501 is recessed forwardly from the back surface 55 of the main portion 50. A positioning pole 5011 is disposed in a front segment of the slot 501 and extends rearward from an inner surface of a front wall 54 of the main portion 50, thus a loop-shaped hollow portion 5012 is formed between the positioning pole 5011 and an inner surface of the front segment of the slot 501. A head portion or front end portion 541 is formed on a front surface of the front wall 54. Furthermore, a cavity portion 542 is recessed inwardly from a front portion of the lateral side 53, and the cavity portion 542 has an inclined back side or a ramp portion 543.

Each of the pusher members 7 includes an operating portion 71, an engaging portion 72 connected to a back edge of the operating portion 71 and obliquely extending inward therefrom and a finger member 73 coupled to a front edge of the operating portion 71 and extending inwardly. The engaging portion 72 defines an opening 720 therein and has a circular-shaped rod portion 721 arranged at an end of the engaging portion 72. A lobe portion 730 is formed on an end of the finger member 73.

The cover 4 is made of insulative material, such as plastic etc. which is molded over the base portion 14 and front segments of the cables 102 so as to have the contacts 2 and signal wires 1021 and power wires 1022 coupled together securely. The protrusion members 142 of the base portion 14 may enhance combination between the base portion 14 and the cover 4.

The slider members 5 are respectively assembled to the corresponding retainer member 15, with the main portion 50 received in the passageway 150, the cavity portion 542 aligning with the slit 1521 of the lateral wall 152. Furthermore, the positioning pole 5011 and the positioning post 1513 are inserted into a front segment and a rear segment of an internal of the spring member 6. The pusher members 7 are respectively mounted to the retainer members 15, with the rod portion 721 accommodated in the cavity portions 1510 and against the tabs 1526, the holder portions 1524 extending through the openings 720 and clipping/sandwiching the rod portions 721, by such arrangement, the engaging portions 72 pivotally engage with the retainer members 15. Furthermore, the finger portions 73 pass through the slits 1521, extend into cavity portions 542 and trend to contact the inclined back sides 543 of the cavity portions 542. The operating portions 71 are disposed outside of the lateral sides 152 and accessible from an exterior.

The spring members 6 can push the slider members 5 forward moving to have header portions 541 exposed outward of a front surface of the retainer members 15 and located at lateral sides of the mounting portion 13. When the operating portions 71 are pressed inwardly, the lobe portions 730 downwardly slide along the ramp portions 543 and exert a rearward force onto the slider members 5 to urge they rearward move along the passageways 150. Then, the alignment members 1512 slide into a front segments of the slots 501, and the spring members 6 are compressed and the header portions 541 of slider members 5 retract into the passageways 150.

When the connector 101 is mounted to the panel 200, the mating portion 12 is firstly aligned with the opening 202 and the head portions 541 are pushed backwardly by the panel 200 or by pusher members 7, then the lock tabs 132 pass through the cutout 203. Secondly, the connector 101 is moved along the transversal direction, and the header portions 541 extends into the opening 202 automatically by resilient force of the spring members 6, thus the mounting portion 13 and the header portions 541 are both accommodated in the opening 202 to inhibit the mounting portion 13 movement along the opening within a certain range such that the lock tabs 132 can't exit out of the opening 202 arbitrarily, therefore the lock tabs 132 and the cover 4 and the retainer members 15 arranged at opposite sides of the panel 200 such that the connector 101 is securely attached to the panel 200. When the connector 101 is detached from the panel 200, a pressing force is exerted to the operating portions 71 of the pusher members 5 to have header portions 541 retract into the passageway 150, and the connector 101 is laterally moved to have the lock tabs 132 exit through cutouts 203.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A connector adapted for mounting to a panel, comprising:

an insulative housing including a mating portion, a mounting portion extending rearward from the mating portion, at least a lock tab formed on a top or a bottom surface of the mating portion and disposed adjacent to the mounting portion;

at least a retainer member connected to a lateral side of the insulative housing, said retainer member having a passageway extending along a front-to-back direction, and an aperture defined in the retainer member and communicating with the passageway;

a slider member including a main portion accommodated in the passageway of the retainer member, said main portion defining a cavity portion with an inclined back side;

a spring member received in the passageway and capable of pushing the main portion sliding forwardly to reach a lateral side of the mounting portion; and a pusher member having a finger portion extending into the cavity portion via the aperture of the retainer member and capable of pressing onto and sliding along the inclined back side to urge the slider member movement rearward.

2. The connector as recited in claim 1, wherein the pusher member has an engaging portion pivotally linked to the retainer member.

3. The connector as recited in claim 2, wherein a holder portion extends rearward from a lateral wall of the retainer member together with a rear wall of the retainer member to form a recess portion therebetween.

4. The connector as recited in claim 3, wherein the engaging portion has a rod portion formed at an end thereof and accommodated in the recess portion.

5. The connector as recited in claim 4, wherein a tab is formed on an inner side of the holder portion, and the rod portion of the engaging portion is against the tab.

6. The connector as recited in claim 5, wherein the holder portion extends through an opening in the engaging portion.

7. The connector as recited in claim 2, wherein an operating portion connects both the finger portion and the engaging portion, and the operating portion is disposed aside of the retainer member.

8. The connector as recited in claim 1, wherein the slider member includes at least a guide member on a top or a bottom surfaces thereof, and a corresponding channel portion is defined in an inner portion of an up or a bottom walls of the retainer member to receive the guide member.

9. The connector as recited in claim 1, wherein a protrusion member is formed on a lateral side of the slider member, and a lock member is formed on an inner surface of a corresponding lateral wall of the retainer member for latching with the protrusion member.

10. The connector as recited in claim 1, wherein an alignment member is disposed in the passageway and formed on an inner surface of a rear wall of the retainer member, and a slot is recessed forwardly from a back surface of the main portion of the slider member for receiving the alignment member.

11. The connector as recited in claim 10, wherein a poisoning pole is disposed in a front segment of the slot and extends rearward from an inner surface of a front wall of the slider member, and positioning post is disposed inside the alignment member and extends forwardly from the rear wall of the retainer, wherein the positioning pole and the positioning post respectively are inserted into the spring member from opposite sides.

12. The connector as recited in claim 1, wherein the insulated housing further comprises a base portion extending rearward from the mounting portion.

13. The connector as recited in claim 12, wherein at least a protrusion member is formed on the base portion, and a cover is molded over the base portion to have the protruding member enclosed therein.

14. A cable assembly adapted to be mounted to a panel, said panel defining an opening and at least a cutout arranged along and in communication with the opening, comprising:

a connector having a mating portion and at least a lock tab formed on one side of the mating portion, said connector mounted to the panel, with the mating portion inserted into the opening, the lock tab extending through the cutout for locking the connector with the panel together;

at least a retainer member connected to a lateral side of the connector and disposed rearward of the panel, said retainer member having a passageway for accommodating a slider member therein;

a spring member arranged inside the passageway of the retainer member for pushing the slider member extending into the opening of the panel;

a pusher member mounted to the retainer member, said retainer member including a finger portion extending into the passageway and located adjacent to a ramp portion of the slider member, and an operating portion connected to the finger portion and accessible from an exterior; and wherein movement the spring member along the ramp portion to urge the slider member retracting into the passageway such that the mating portion is capable of exiting from the opening of the panel.

15. The cable assembly as recited in claim 14, wherein the pusher member is pivotally linked to the retainer member via an engaging portion connected thereof.

16. The cable assembly as recited in claim 15, wherein the engaging portion is connected to end of the operating portion and deflected inwardly.

17. The cable assembly as recited in claim 14, wherein a slit is defined in a front segment of the retainer member, and the finger portion extends into the passageway through the slit.

18. A cable connector assembly comprising:

a panel defining an opening;

an electrical connector including:

an insulative housing defining a base with a mating port forwardly extending therefrom;

a plurality of contacts disposed in the housing with contacting sections extending into the mating port;

a slider being moveable relative to the housing along a front-to-back direction;

a biasing device urging the slider toward a forward position; and a pusher located beside said slider and being movable relative to the housing in generally a transverse direction to actuate said slider to move toward a rearward position; wherein said mating port is configured and dimensioned to be initially forwardly inserted through the opening and successively moved in a first lateral direction to have an abutment section of the connector abut against the panel for preventing rearward movement of the connector relative to the panel, under a condition that the slider urged by the biasing device invades the opening at the forward position to prevent the mating port from moving in a second lateral direction opposite to said first lateral direction so as to assure reliable securement of the connector with regard to the panel.

19. The cable connector assembly as claimed in claim 18, wherein said opening extends in a lengthwise direction parallel to said first lateral direction while perpendicular to said front-to-back direction.

20. The cable connector assembly as claimed in claim 18, wherein said transverse direction is parallel to said first lateral direction.

* * * * *